United States Patent [19]

Taguchi et al.

[11] Patent Number: 4,914,806

[45] Date of Patent: Apr. 10, 1990

[54] METHOD OF MANUFACTURING CONTACT BLOCK

[75] Inventors: Jisei Taguchi, Atsugi; Manabu Tada, Hiratsuka, both of Japan

[73] Assignee: Anritsu Corporation, Tokyo, Japan

[21] Appl. No.: 304,850

[22] PCT Filed: May 30, 1988

[86] PCT No.: PCT/JP88/00528

§ 371 Date: Jan. 18, 1989

§ 102(e) Date: Jan. 18, 1989

[87] PCT Pub. No.: WO88/10003

PCT Pub. Date: Dec. 15, 1988

[30] Foreign Application Priority Data

May 30, 1987 [JP] Japan ..... 62-136151

[51] Int. Cl.[4] ..... H01H 11/04

[52] U.S. Cl. ..... 29/622; 29/827; 29/883; 200/1 A; 200/51 R

[58] Field of Search ..... 29/622, 827, 883; 264/272.14; 200/1 A, 51 R

[56] References Cited

U.S. PATENT DOCUMENTS

| | | | |
|---|---|---|---|
| 4,356,465 | 10/1982 | Agatanama | 29/622 |
| 4,490,903 | 1/1985 | Agatahama | 29/622 |
| 4,595,805 | 6/1986 | Masuda | 29/622 |
| 4,783,906 | 11/1988 | Gingerich et al. | 29/827 |

FOREIGN PATENT DOCUMENTS

| | | |
|---|---|---|
| 57-138740 | 8/1982 | Japan . |
| 60-208019 | 10/1985 | Japan . |

*Primary Examiner*—P. W. Echols

*Attorney, Agent, or Firm*—Frishauf, Holtz, Goodman & Woodward

[57] ABSTRACT

A method of manufacturing a contact block includes the processes of forming make contact pieces, break contact pieces, base pieces, and terminal pieces in a first hoop member by blanking, forming a first subcontact block having the break contact pieces and a second subcontact block having the make contact pieces by molding these pieces, forming movable contact spring pieces by blanking a second hoop member, aligning the second hoop member with the first hoop member and welding the movable contact spring pieces to the base pieces, cutting off the movable contact spring pieces from the second hoop member, and cutting off the first or second subcontact block from the first hoop member and aligning/coupling these subcontact blocks to each other. According to these processes, the respective components are held on a loop member up to the final process so that contamination and deformation of these components can be prevented. Since the first and second subcontact blocks are formed on the first hoop member, management of molding conditions and lot management can be facilitated.

2 Claims, 12 Drawing Sheets

METHOD OF MANUFACTURING CONTACT BLOCK

[TECHNICAL FIELD]

The present invention relates to a method of manufacturing a contact block used in a relay or the like and, more particularly, to a method of manufacturing the contact block with high quality.

[BACKGROUND ART]

A small relay is generally constituted by components such as a contact block, a coil, a yoke, an armature, and a driving card. The contact block is an integral member formed by assembling contact components such as make contacts, break contacts, and movable contact springs in accordance with a predetermined positional relationship. When the coil is biased, the armature is moved, and the movable contact springs of the contact block are moved through the driving card, thereby performing a switching operation of a relay contact. In such a small relay, the contact switching characteristics, reliability, and the like of the relay are greatly influenced by the precision of the contact block. As a demand has arisen for a smaller relay, the precision and reliability of the contact block are required to be further increased.

In order to increase the precision of the contact block, according to a conventional method, a plurality of make contacts, break contacts, and movable contact springs are integrally formed by molding using a resin so as to form subassemblies, and the subassemblies are assembled to form a contact block. Japanese Patent Publication (Kokoku) No. 57-22174 and Japanese Patent Disclosure (Kokai) No. 58-14440 disclose such a contact block.

Such a contact block, however, is assembled after subassemblies of make contacts, break contacts, movable contact springs, and the like are independently separated. Consequently, subassemblies which are processed and managed under the same conditions may sometimes be assembled together, and subassemblies which are obtained by different processes or from different lots may sometimes be assembled together, thus posing limitations in precision and reliability.

In order to solve such a problem, another method has been developed. According to this method, these contact members are blanked from a hoop member and are integrally formed by using a resin member, and final contact blocks are completed by assembling contacts and movable contact springs on this hoop member in successive processes, and are sequentially cut off.

Such a method will be described below with reference to FIGS. 14 to 18. As shown in FIG. 14, blanking of first hoop member 1 is performed by a blanking unit (not shown) so as to form pairs of coil contact pieces, base pieces 3, break contact pieces 4, and make contact plate pieces 5. These pairs of pieces are arranged to be symmetrical about the central line of hoop member 1. These pieces are coupled to hoop member 1 through coupling portions 6 and the like. Subsequently, first hoop member 1 blanked in this manner is transferred to a molding unit (not shown) so as to mold intermediate portions of coil contact pieces 2, base pieces 3, break contact pieces, and make contact plate pieces 5, thereby forming a pair of right and left insulating blocks 17 made of a resin material. After this process, coupling portions 8*a*, 8*b*, and 8*c* are cut off.

As shown in FIG. 15, a second hoop member having a width larger than that of the first hoop member is blanked by a blanking unit (not shown) independently from the first hoop member so as to form a pair of movable contact spring plate pieces 10. These movable contact plate pieces are arranged to be symmetrical about the central line of the second hoop member, and are coupled thereto through coupling portion 11. Contacts 12 and 13 are respectively welded to the distal end portions of movable contact spring plate pieces 10 in this state. Intermediate portions 10*a* of plate pieces 10 are then bent by tension.

Subsequently, second hoop member 9 is aligned with a portion between insulating blocks 7 of first hoop member 1. The proximal end portions of movable contact plate pieces 10 of the second hoop member are respectively welded to base pieces 3 of the first hoop member, and movable contact spring plate pieces 10 are cut off from second hoop member 9 by using a cutting unit (not shown), as show in FIG. 16. Thereafter, as shown in FIG. 17, base pieces 3, break contact plate pieces 4, and make contact plate pieces 5 are bent by a bending unit (not shown) from the lower surface side to the upper surface side along the edges of insulating blocks 7 at a right angle. Upon this bending operation, the contacts of break contact plate pieces 4 are respectively brought into contact with the upper surfaces of movable contact spring plate pieces 10, while the contacts of make contact plate pieces 5 oppose the lower surfaces of movable contact spring plate pieces 10. Thereafter, these members are cut off from first hoop member 1 so as to form contact blocks 14, as shown in FIG. 18. Each contact block 14 is obtained by integrally assembling a make contact, a break contact, and a movable contact spring, and constitutes a single contact block. By assembling a plurality of contact blocks as needed, a contact block assembly having a plurality of contacts can be formed.

FIG. 19 shows another manufacturing method. According to this method, a hoop member is blanked to form, e.g., two break contacts 21 and 22 and a plurality of terminals 25. These contacts and terminals are integrally molded by a resin material and then are cut off from the hoop member, thereby forming base block 20, as shown in FIG. 19. Subsequently, movable contact springs 23 and 24 and make contact 26 punched from the hoop member are aligned and welded on base block 20 in the above-described manner. With this process, a two-contact type contact block is manufactured.

In the above-described method, since processes such as molding, welding, and bending are performed in a state wherein the respective components blanked from a hoop member are coupled to this hoop member through corresponding coupling pieces, various processing and assembly up to the final process are performed on this hoop member. Therefore, by only supplying a blanked hoop member to a processing/assembly unit, no manual work is required up to the final assembly operation, and hence high precision can be maintained.

In the method shown in FIGS. 14 to 18, however, the components are finally divided into units of contact blocks 14, as shown in FIG. 18. Consequently, when a plurality of contact blocks 14 are assembled and a contact block assembly having a plurality of contacts is to be manufactured, matching of the respective characteristics of blocks 14 becomes difficult. Especially when molding using a resin is performed, maintenance of an injection molding unit and lot management, and the like must be performed with high accuracy in order to match the characteristics of contact blocks 14 because deformation of insulating blocks slightly varies depending on the temperature of an injection molding unit and an elapsed time upon molding. In spite of such accurate maintenance, satisfactory conditions are difficult to obtain. For this reason, when a small, high-precision contact block is to be manufactured, timings of contacting/separating of contacts are slightly deviated from each other, and a succeeding characteristic test becomes cumbersome, and hence the yield is decreased. Furthermore, in the method shown in FIG. 19, three types of hoop members or contact plate springs processed in another process as a single part must be supplied to the processing/assembly unit. Consequently, the structure of this processing/assembly unit becomes complex, and the assembly precision is degraded.

[DISCLOSURE OF INVENTION]

The present invention has been made in consideration of the above situation, and has as its object to provide a method of manufacturing a high-precision, high-reliability contact block.

According to a first characteristic feature of the present invention, there is provided a method comprising the steps of forming a required number of make contact pieces, break contact pieces, base pieces, and terminal pieces in a first hoop member by blanking, forming insulating blocks by molding the make contact pieces, the break contact pieces, the base pieces, and the terminal pieces coupled to the first hoop member through coupling portions, thereby forming a first subcontact block having at least the break contact pieces, and a second subcontact block having at least the make contact pieces, blanking a second hoop member to form movable contact spring pieces and bending the movable contact spring pieces by tension while the movable contact spring pieces are coupled to the second hoop member through coupling portions, aligning the second hoop member with the first hoop member and welding the movable contact spring pieces to the base pieces, cutting off the movable contact spring pieces from the second hoop member, and cutting off one of the first and second subcontact blocks from the first hoop member and aligning and coupling the first and second subcontact blocks to each other.

According to the present invention, therefore, since each component is processed while being coupled to the hoop member up to the final assembly process, no manual operation is required in intermediate processes. Therefore, each component is free from contamination and deformation. In addition, since the make contact pieces, the break contact pieces, the base pieces, and the terminal pieces are blanked from the same first hoop member, and these pieces are integrally formed by molding while they are coupled to the first hoop member, the blanking and molding processes can be simultaneously performed in the same unit. Since blanking and molding of these pieces are performed under the same conditions, the positional relationship and shapes of these piece can be set very accurately, and hence a high-quality contact block can be manufactured. Since one set of these pieces is formed on the first hoop member, and this first hoop member is supplied to the final assembly process, lot management of each piece can be facilitated. Moreover, since only the first hoop member is supplied to the final assembly process, the structure of a processing/assembly unit can be simplified.

According to a second characteristic feature of the present invention, the terminal pieces are bent, and the bent pieces are urged into holes formed in the insulating blocks, thereby assembling the first and second subcontact blocks. With this process, assembly is facilitated, and accurate positioning of the make contact pieces, the break contact pieces, movable contact springs, and the like can be realized.

[BRIEF DESCRIPTION OF DRAWINGS]

FIGS. 1 to 12 are views for explaining a method of manufacturing a contact block according to an embodiment of the present invention, in which:

FIG. 1 is a block diagram showing the order of processes of the manufacturing method;

FIG. 2 is a view for explaining a first blanking process

FIG. 3 is a view for explaining a molding process;

FIGS. 4 to 6 are views for explaining a second blanking process;

FIG. 7 is a view for explaining an aligning process;

FIGS. 8 to 10 are views for explaining a cutting process;

FIG. 11 is a view showing an outer appearance of a manufactured contact block; and FIG. 12 is a view showing a state wherein the contact block is assembled with an electromagnet;

[BEST MODE OF CARRYING OUT THE INVENTION]

Figure 1:
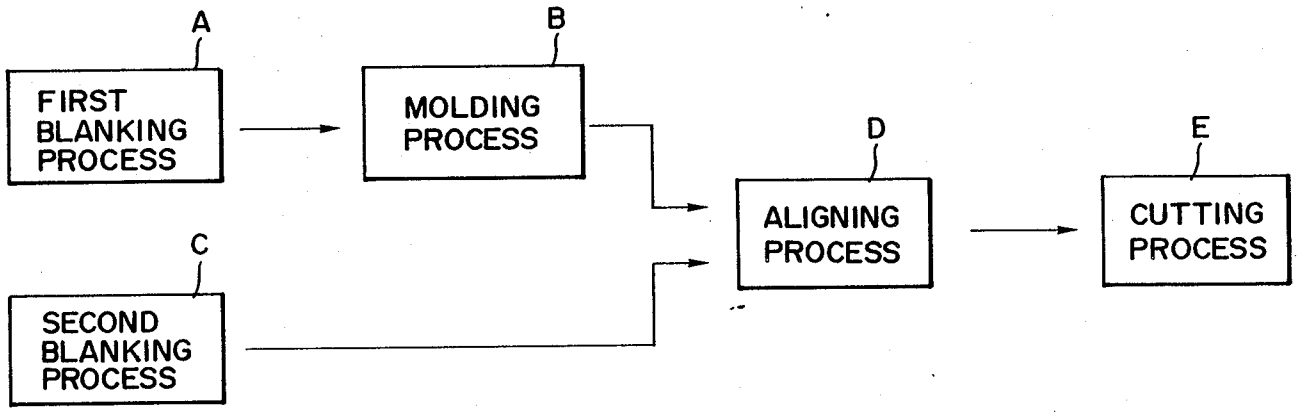
Figure 2:
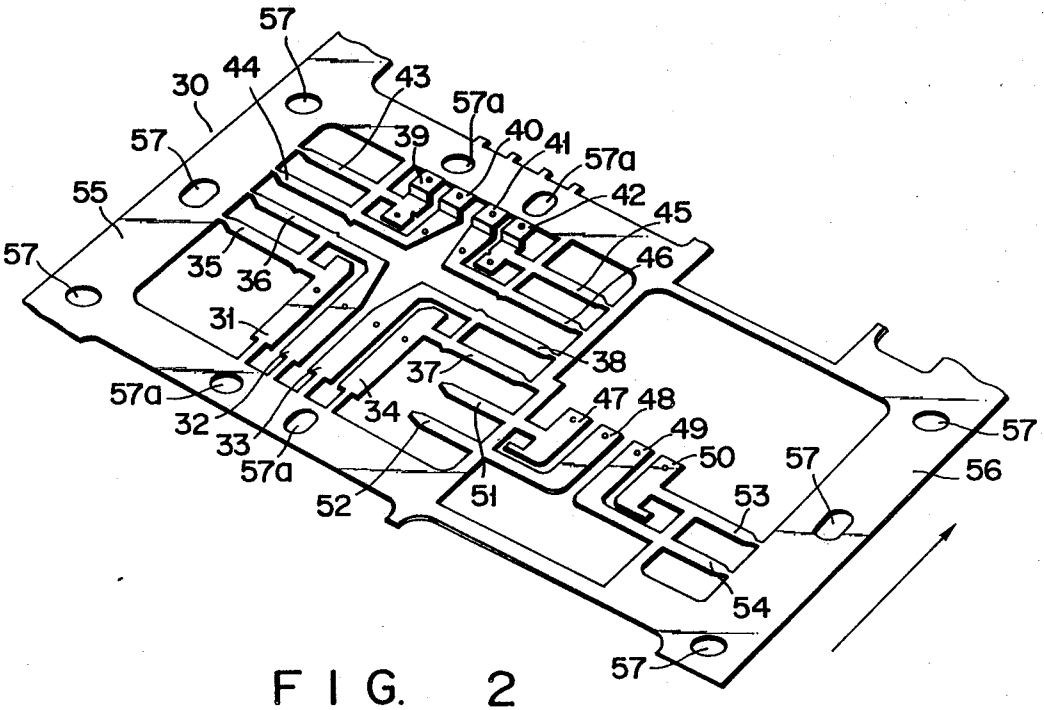
Figure 3:
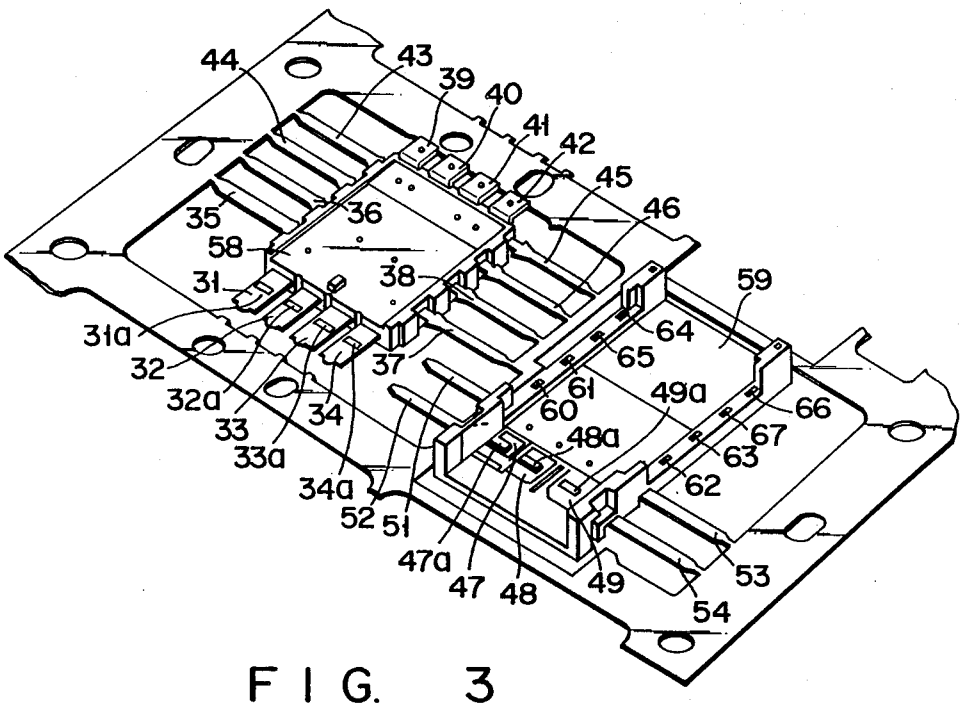

A method according to an embodiment of the present invention will be described below with reference to FIGS. 1 to 13. FIG. 1 is a view illustrating manufacturing processes of the present invention. The processes will be sequentially described one by one in accordance with FIG. 1. As shown in FIG. 2, in first blanking process A, break contact pieces 31, 32, 33 and 34, terminal pieces 35, 36, 37, and 38 respectively connected thereto, base pieces 39, 40, 41, and 42, and terminal pieces 35 to 38, and 43 to 46 respectively connected thereto are formed on a left portion of first hoop member 30 substantially about its center by blanking and bending. In addition, make contact pieces 47, 48, 49, and 50 and terminal pieces respectively connected thereto are simultaneously formed on a right portion of the first hoop member substantially about its center by blanking. FIG. 2 shows only one set of pieces. In practice, however, a large number of sets of pieces are consecutively formed on the first hoop member. A portion of each piece is coupled to the first hoop member through a corresponding coupling portion. This coupling portion is cut off in a subsequent process. These pieces are accurately located at the same positions as those in an assembly state. Lead frame portions 55 and 56 are formed on both the sides of hoop member 30. Pitch holes 57 for feeding and positioning of the hoop member are formed in lead frame portions 55 and 56.

First hoop member 30 blanked in this manner is supplied to molding process B. In this process, blanked first hoop member 30 is molded by a molding die, and the above pieces are embedded in a synthetic resin material, thereby forming first and second insulating blocks 58 and 59. First insulating block 58 is obtained by embedding break contact pieces 31 to 34, base pieces 39 to 42, and terminal pieces 35 to 38, and 43 to 46 respectively connected thereto and integrally coupling them to each other in a predetermined positional relationship, thereby constituting a first subcontact block. Second insulating block 59 is obtained by embedding make contact pieces 47 to 50, and terminal pieces 51 to 54 respectively connected thereto and integrally coupling them to each other so as to establish a predetermined positional relationship, thereby constituting a second subcontact block. Insertion holes 60 to 67 are formed on both sides of second insulating block 59 at positions corresponding to terminal pieces 35 to 38, and 43 to 46. When these terminals are urged into the insertion holes in a subsequent process, first and second insulating blocks 58 and 59 are coupled to each other so as to establish a predetermined positional relationship.

Subsequently, contacts 31*a* to 34*a* are respectively welded to break contact pieces 31 to 34, and contacts 47*a* to 50*a* are respectively welded to make contact pieces 47 to 50. Note that the respective pieces are positioned such that these contacts are arranged on straight lines perpendicularly crossing first hoop member 30, and that make contact pieces are exposed from insulating block 59 so as to allow an electrode to be inserted on the lower surface to which the contacts are to be welded, thereby facilitating welding of the contacts. Thereafter, the coupling portions between the distal end portions of break contacts 31 to 34 and frame 55 are cut off.

Figure 4:
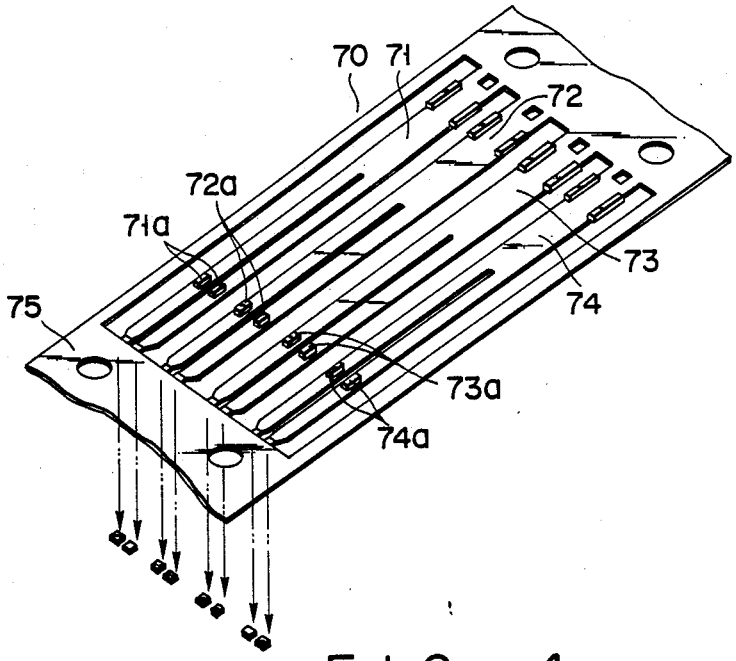
Figure 5:
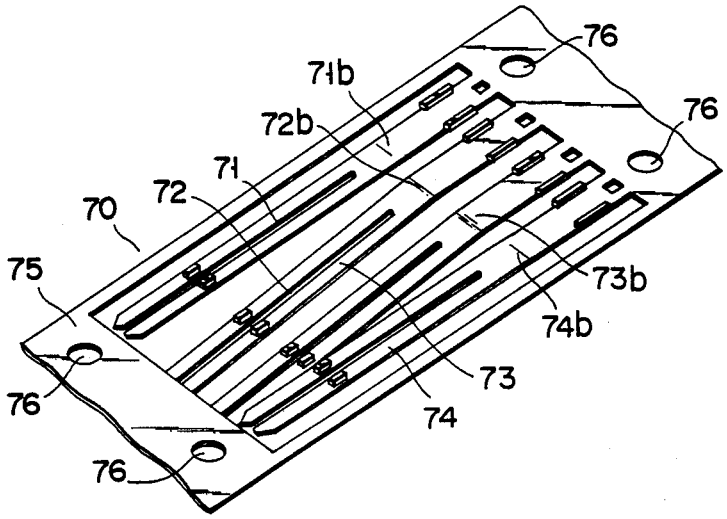
Figure 6:
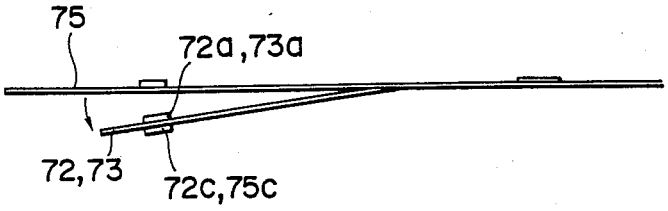
Figure 7:
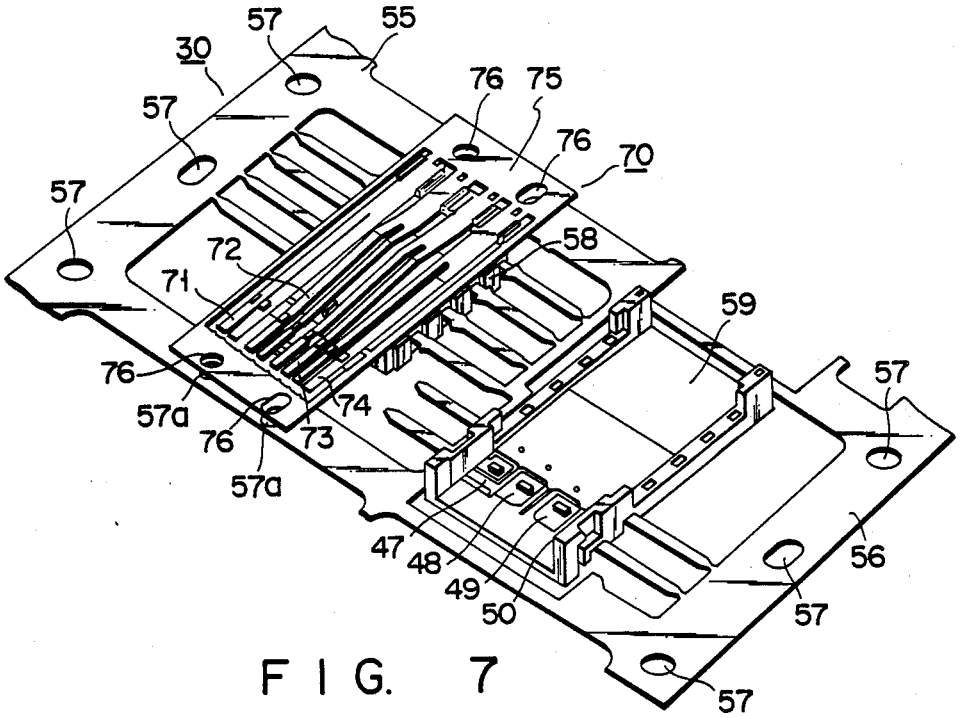
Figure 8:
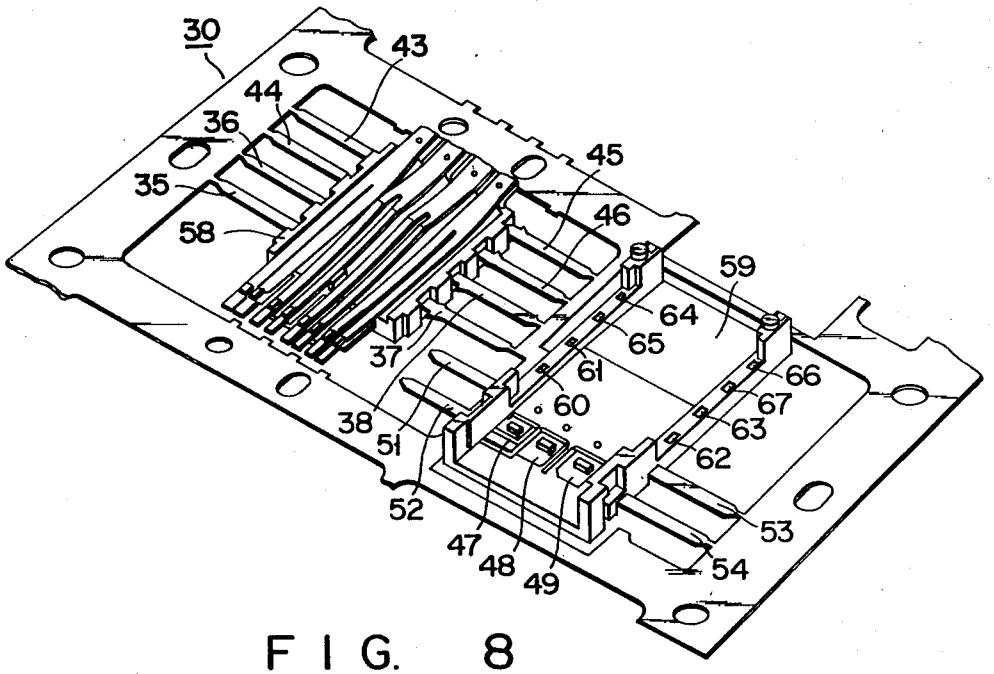

A second hoop member is blanked in second blanking process C independently from the above process. As shown in FIG. 4, in this process, second hoop member 70 is supplied to a blanking unit (not shown) so as to form movable contact spring pieces 71, 72, 73, and 74 in second hoop member 70 by blanking. Note that slits are formed in the distal end portions of movable contact spring pieces 71 to 74. Movable contact spring pieces are coupled to second hoop member 70 through coupling portions. Upon blanking, each of contacts 71*a* to 74*a* is welded to one or both surfaces of a corresponding one of movable contact spring pieces 71 to 74. After this welding process, the coupling portions between the distal end portions of movable contact spring pieces 71 to 74 and frame 75 are cut off. Note that a surface of each contact is formed into a crown-like shape. Subsequently, as shown in FIG. 5, each movable contact spring piece is subjected to a predetermined tension-bending process. Although in this embodiment only movable contact spring pieces 72 and 73 are subjected to the tension-bending process, tension-bending may be performed for a single or all the movable contact spring pieces. Pitch holes 76 for feeding and positioning of second hoop member 70 are formed therein.

Second hoop member 70 is aligned with first hoop member 30 in aligning process D. This process will be described with reference to FIG. 7. That is, second hoop member 70 is aligned such that movable spring pieces 71 to 74 thereof correspond to break contact pieces 31 to 34 and base pieces 39 to 42 of first hoop member 30, respectively. Positioning of these members is accurately performed by using pitch holes 57 and 76 of first and second hoop members 30 and 70. In this state, the proximal end portions of movable contact spring pieces 71 to 74 are respectively welded to base pieces 39 to 42.

Figure 9:
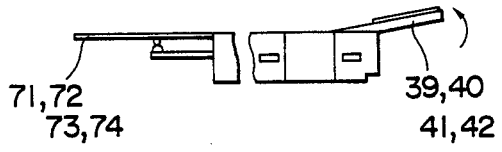

When this welding is finished, movable contact spring pieces 71 to 74 are completely cut off from second hoop member 70 in cutting process E. In addition, base pieces 39 to 42 are bent as shown in FIG. 9. Contacts 72*c* and 73*c* opposing contacts 72*a* and 73*a* of movable contact spring pieces 72 and 73 are processed so as to be brought into contact with the corresponding break contacts at a predetermined pressure.

Figure 10:
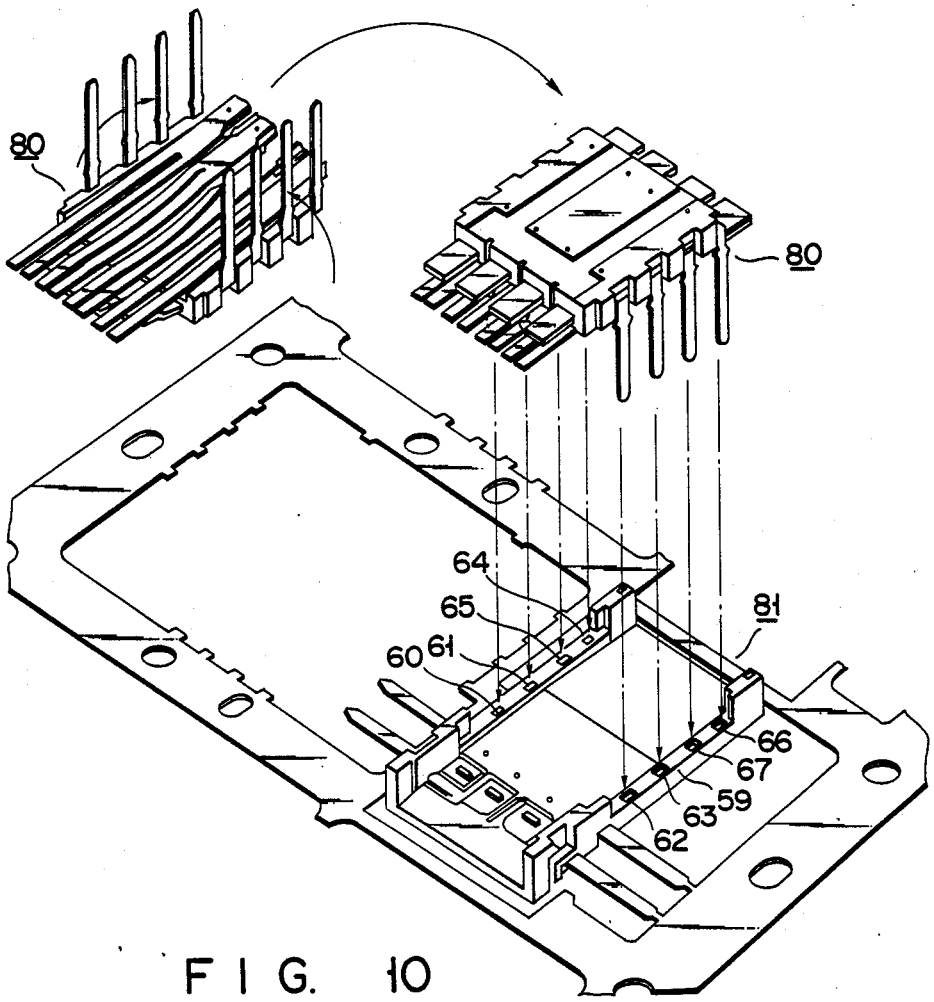

The first hoop member on which movable contact spring pieces 71 to 74 are mounted is supplied to the final processing/assembly process. In this process, as shown in FIG. 10, terminal pieces 35 to 38, and 43 to 46 are cut off from lead frames 55 and 56, and are bent upward at a right angle. Thereafter, an assembly of the cut break contacts and movable contact springs, i.e., first subcontact block 80, is reversed and mounted on an assembly of the make contacts, i.e., second subcontact block 81. Terminals 35 to 38, and 43 to 46 extending from first subcontact block 80 are respectively urged into insertion holes 60 to 67 of insulating block 59 of second subcontact block 81, so that first and second subcontact blocks 80 and 81 are coupled to each other so as to establish a predetermined positional relationship. Thereafter, second subcontact block 81 is cut off from first hoop member 30, and a contact block is completed.

Figure 11:
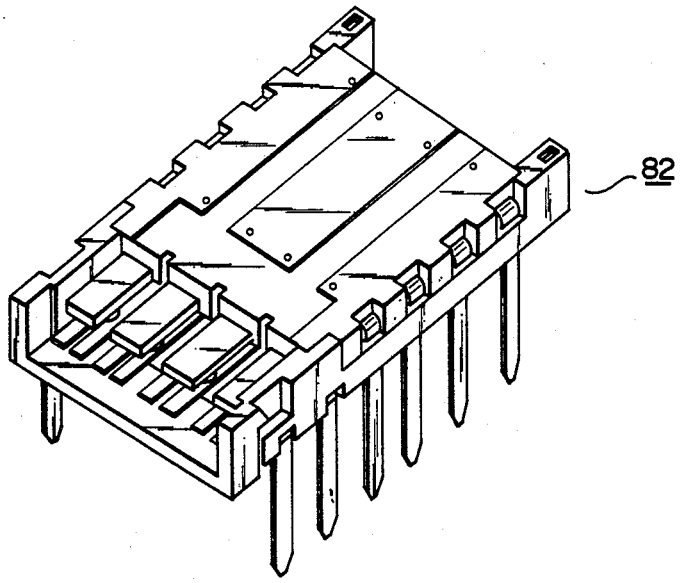
Figure 12:
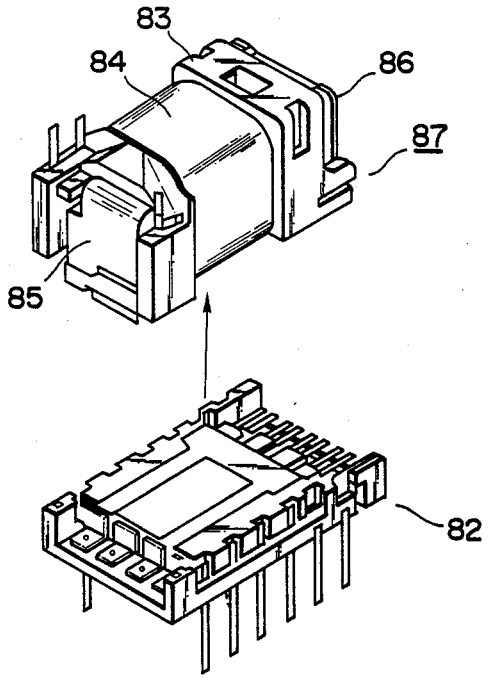
Figure 13:
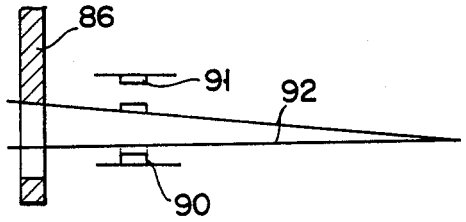
FIG. 13 is a view illustrating a modification of the movable contact spring.
Figure 14:
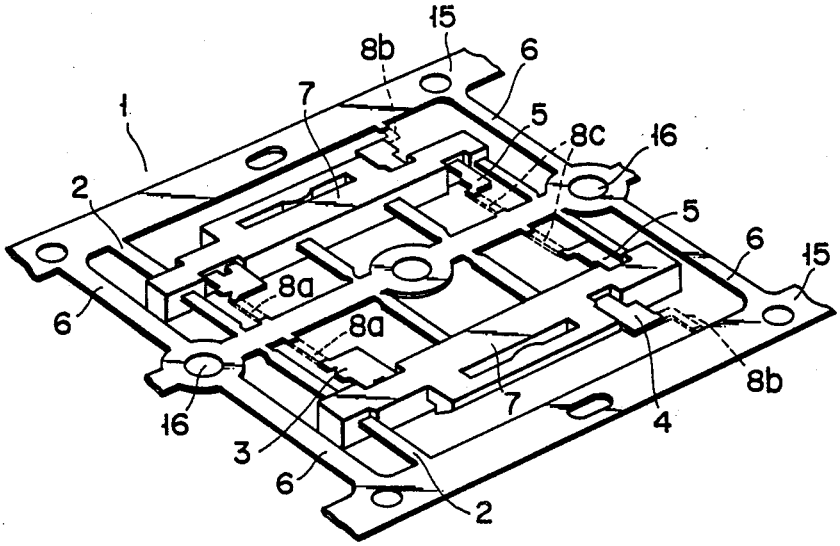
F I G. 14 PRIOR ART
FIGS. 14 to 19 are views for explaining a conventional method of manufacturing a contact block.
Figure 15:
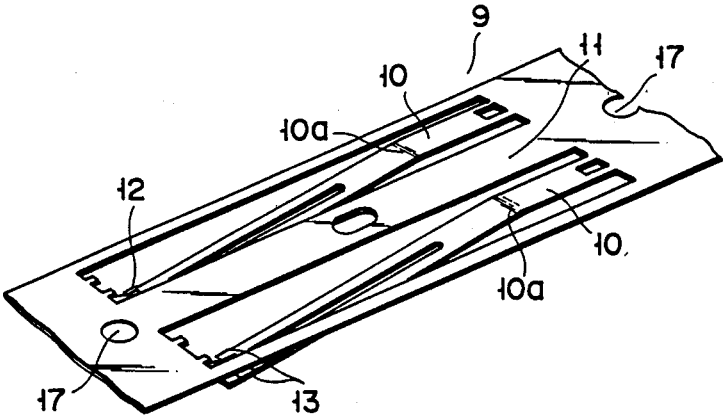
F I G. 15 PRIOR ART
Figure 16:
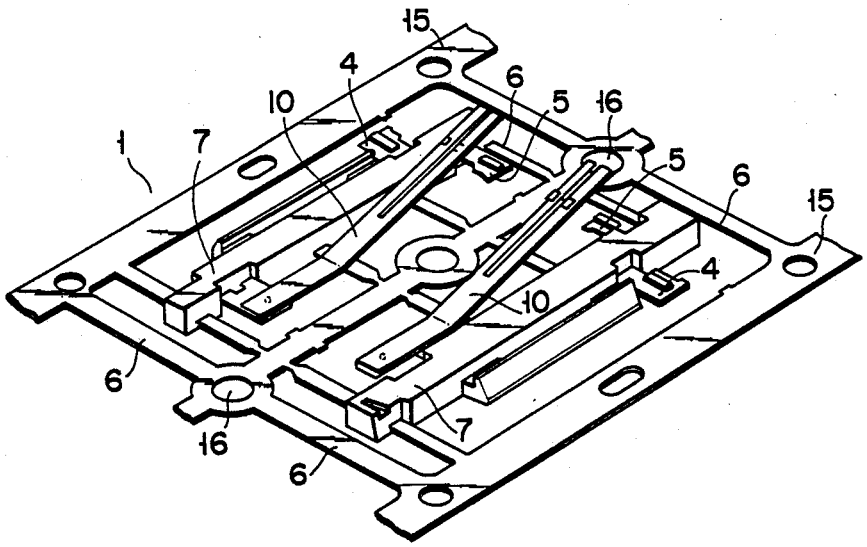
FIG. 16 PRIOR ART
Figure 17:
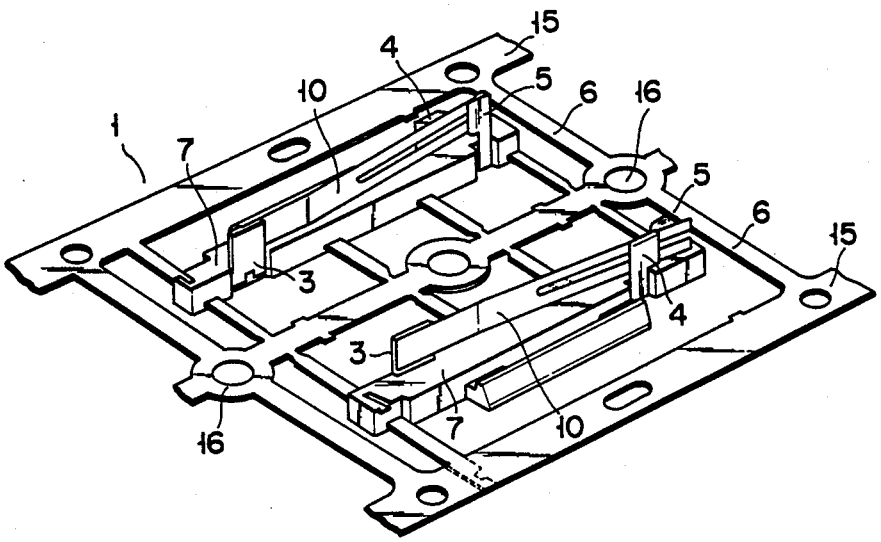
FIG. 17 PRIOR ART
Figure 18:
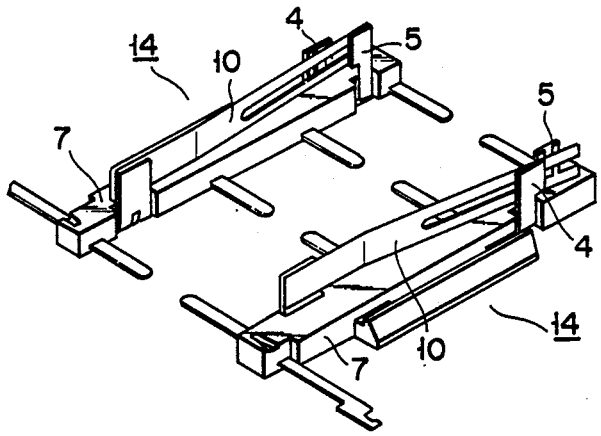
FIG. 18 PRIOR ART
Figure 19:
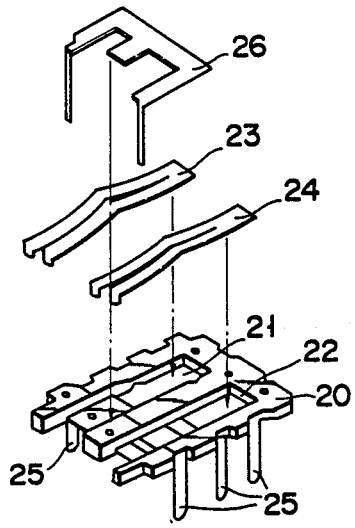
FIG. 19 PRIOR ART
Figure 14:
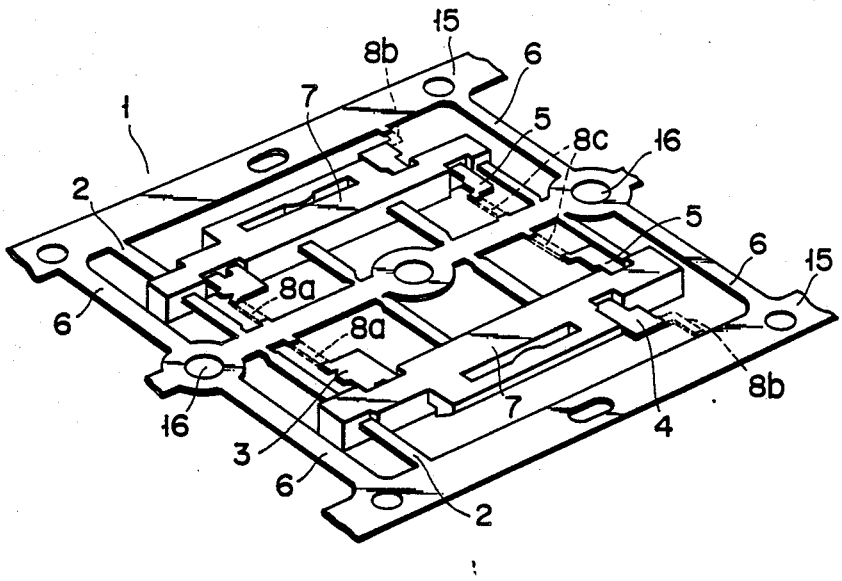
Figure 15:
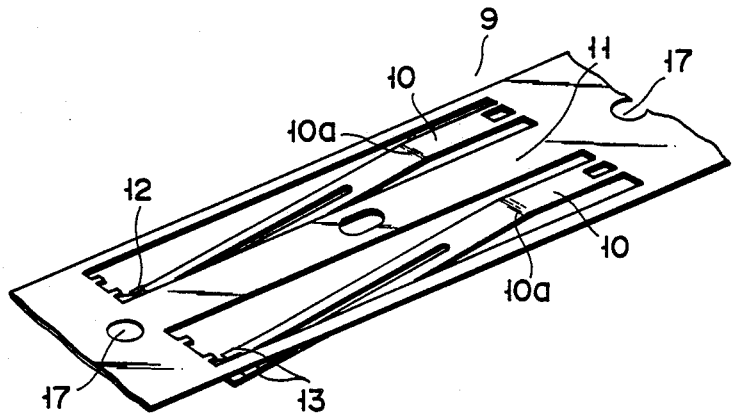
Figure 16:
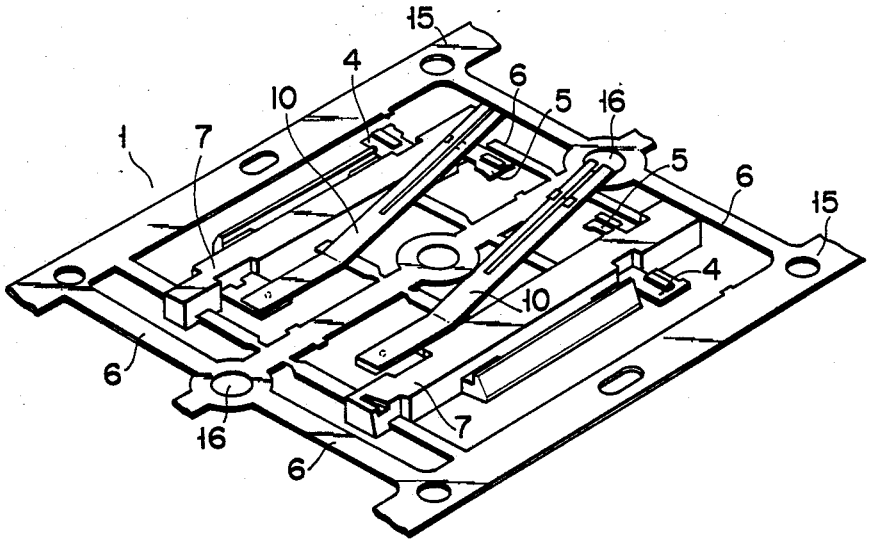
Figure 17:
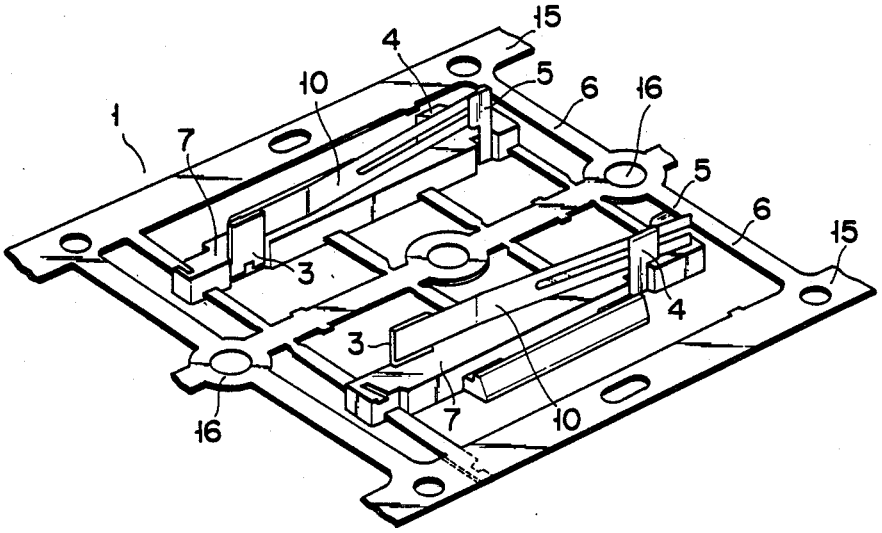
Figure 18:
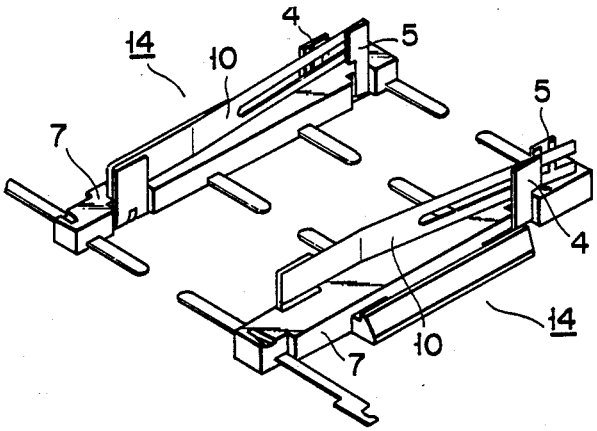
Figure 19:
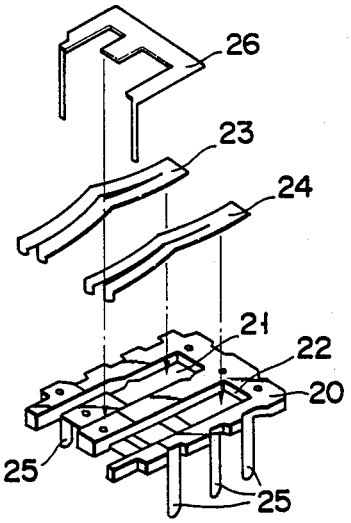

FIG. 11 shows contact block 82 manufactured in this manner. Contact block 82 is assembled with coil assembly 87 in another process complete to a relay, as shown in FIGS. 12 and 13. Referring to FIGS. 12 and 13, reference numeral 83 denotes a coil bobbin. Coil 84 is wound around coil bobbin 83. The coil assembly comprises armature 85, a yoke (not shown), driving card 86 for driving the movable contact springs, and the like.

The present invention is not limited to the above embodiment. For example, a method of coupling the first contact block to the second contact block is not limited to the method in the embodiment, wherein the terminals are urged into the insertion holes of the insulating block, but another method may be employed.

In the final process, instead of cutting off the first contact block from the first hoop member, the second contact block may be cut off from the first hoop member, and the second hoop member may be mounted/-coupled on/to the first hoop member.

The arrangement of the first and second subcontact blocks is not limited to that in the embodiment. For example, the base pieces may be molded to the second subcontact block.

We claim:

1. A method of manufacturing a contact block, comprising the steps of:

forming a predetermined number of make contact pieces, break contact pieces, base pieces, and terminal pieces in a first hoop member by blanking, said pieces being coupled to said first hoop member through coupling portions;

forming first and second insulating blocks in which said make contact pieces, said break contact pieces, said base pieces, and said terminal pieces are integrally embedded by molding, thereby obtaining a first subcontact block including at least said break contact pieces, and a second subcontact block including at least said make contact pieces;

forming movable contact spring pieces in a second hoop member by blanking, said movable contact spring pieces being coupled to said second hoop member through coupling portions, and tension-bending said movable contact spring pieces;

aligning said second hoop member with said first hoop member and welding said movable contact spring pieces to said base pieces, respectively;

cutting off said movable spring contact pieces from said second hoop member; and cutting off one of said first and second subcontact blocks from said first hoop member, and aligning and coupling said first and second subcontact blocks to each other.

2. A method according to claim 1, wherein the step of coupling said first and second subcontact blocks to each other is performed by urging terminals of said first or second subcontact block into insertion holes formed in said insulating block of said second or first subcontact block.

* * * * *